US007501760B2

(12) United States Patent
Hwang et al.

(10) Patent No.: US 7,501,760 B2
(45) Date of Patent: Mar. 10, 2009

(54) PLASMA DISPLAY DEVICE HAVING WALLS THAT PROVIDE AN EXHAUST PATH

(75) Inventors: Eui-Jeong Hwang, Suwon-si (KR); Min-Sun Yoo, Suwon-si (KR); Tae-Ho Lee, Suwon-si (KR); Yon-Goo Park, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 424 days.

(21) Appl. No.: 11/305,072

(22) Filed: Dec. 16, 2005

(65) Prior Publication Data

US 2006/0164010 A1 Jul. 27, 2006

(30) Foreign Application Priority Data

Jan. 25, 2005 (KR) ..... 10-2005-0006710

(51) Int. Cl.
*H01J 17/49* (2006.01)

(52) U.S. Cl. ..... 313/582; 313/292

(58) Field of Classification Search ..... 313/582–587, 313/292

See application file for complete search history.

(56) References Cited

U.S. PATENT DOCUMENTS

| | | | | |
|---|---|---|---|---|
| 6,608,441 | B2 * | 8/2003 | Kunii et al. | 313/584 |
| 6,747,409 | B1 * | 6/2004 | Han et al. | 313/582 |
| 7,271,538 | B2 * | 9/2007 | Sugimoto et al. | 313/582 |
| 2004/0000873 | A1 * | 1/2004 | Moon | 313/587 |
| 2004/0169473 | A1 * | 9/2004 | Yoon et al. | 313/582 |
| 2007/0075640 | A1 * | 4/2007 | Takada et al. | 313/582 |

FOREIGN PATENT DOCUMENTS

| | | | |
|---|---|---|---|
| CN | 1344005 | A | 4/2002 |
| CN | 1538486 | A | 10/2004 |
| JP | 05-121006 | | 5/1993 |
| JP | 2000-331613 | | 11/2000 |
| JP | 2000-357459 | | 12/2000 |
| JP | 2003-132805 | | 5/2003 |
| KR | 10-2001-0077465 | A | 8/2001 |
| KR | 10-2006-0042428 | | 5/2006 |

* cited by examiner

*Primary Examiner*—Joseph L Williams
(74) *Attorney, Agent, or Firm*—Knobbe, Martens, Olson & Bear, LLP

(57) ABSTRACT

A plasma display panel having improved exhaust efficiency is disclosed. A plasma display panel according to a first embodiment of the invention includes first and second substrates opposing each other; barrier ribs that are located in a space between the first substrate and the second substrate for dividing a plurality of discharge cells in sealed spaces; display electrodes located along the discharge cells; and address electrodes formed in a direction intersecting the display electrodes. The barrier ribs include first barrier ribs having a first height and second barrier ribs having a second height so that the difference in height between the two ribs is provided.

17 Claims, 8 Drawing Sheets

PLASMA DISPLAY DEVICE HAVING WALLS THAT PROVIDE AN EXHAUST PATH

CROSS-REFERENCE TO RELATED APPLICATION

This application claims priority to and the benefit of Korean Patent Application No. 10-2005-0006710 filed in the Korean Intellectual Property Office on Jan. 25, 2005, the entire content of which is incorporated herein by reference.

BACKGROUND

1. Technical Field

The present invention relates to a plasma display panel device, and more particularly, to a plasma display panel having improved exhaust efficiency.

2. Discussion of the Related Technology

Generally, a plasma display panel (hereinafter, referred to as a PDP) is a display device in which ultraviolet rays, emitted from the plasma generated by gas discharge, excite phosphors to emit visible light, and thereby realize predetermined images.

PDP devices using three-electrode surface-discharge-type structure have been widely known. This type of PDP device includes a first substrate, display electrodes formed on the side of the first substrate, a second substrate spaced away from the first substrate and address electrodes formed on the side of the second substrate and in a direction generally perpendicular to the display electrodes. The display electrodes include scan electrodes and sustain electrodes. A discharge gas is sealed in the space between the two substrates.

Discharge is initiated by applying an appropriate voltage between the address electrodes and scan electrodes. The discharge is continued by applying a sustain voltage between a pair of sustain and scan electrodes, thereby generating luminance.

Display electrodes are formed on the first substrate which forms a front panel of the PDP devices. The display electrodes are generally elongate in one direction. In addition, the display electrodes are typically covered with a dielectric layer and a protective layer is formed thereon.

On the other hand, the address electrodes are formed on the second substrate which forms a rear panel of the PDP device. The address electrodes are typically covered with a dielectric layer. A plurality of barrier ribs, partition the space between the first and second substrates into independent discharge spaces, called discharge cells.

To form these barrier ribs, a sand blasting method may be used. According to this method, a barrier rib paste is prepared by mixing filler, glass powder, a binder, and a solvent and applying the mixture on the dielectric layer. Then the paste is dried at a temperature of about 120° C., by which solvent is volatilized to form a layer of the barrier rib material.

Next, patterns of the discharge cells are transferred to the barrier rib layer using photoresist. A dry film resist is attached to the barrier rib layers, and the dry film resist is exposed and developed using a mask, to transfer the patterns. In addition, a sand blasting process is performed using the patterned dry film resist, and portions of the barrier rib layer are then selectively removed, leaving barrier rib structures.

Then, the dry film resist on the remaining barrier rib structures is removed, and the barrier rib structures are baked at a temperature of about 500° C. to form barrier ribs. The binder is evaporated and the glass power is dissolved and solidified, and the glass powder reacts with the filler to form the barrier ribs.

As noted above, the barrier ribs formed in this way partition the space between the first and the second substrates into respective independent discharge spaces, which improve discharge efficiency. Specifically, the individual discharge spaces partitioned by these barrier ribs increases the size of the phosphor-applied area However, the individualized (closed) structure of the discharge space (cell) has low exhaust efficiency as discussed below. In the manufacturing of PDP devices, after the rear substrate and the front substrate are bonded together to form a sealed space, impurities remaining in the sealed space need to be exhausted, and each discharge cell is filled with a discharge gas. However, when the discharge cells have the closed structure, exhausting the impurities may be difficult since each discharge cell occupies its own independent space.

In order to solve the above-mentioned problems, a technology has been suggested in which exhaust grooves are formed in the barrier ribs to provide passages between the respective discharge cells. However, this technology is disadvantageous in that the manufacturing process becomes complicated to create exhaust grooves. The foregoing discussion does not constitute an admission of prior art.

SUMMARY OF CERTAIN INVENTIVE ASPECTS

One aspect of the invention provides a plasma display device. The device comprises: a first substrate having a substantially planar surface; a second substrate opposing the first substrate; and a plurality of barrier ribs that are located between the first substrate and the second substrate to partition a plurality of discharge cells, in which the plurality of barrier ribs comprising a first barrier rib and a second barrier rib. In the device, the first barrier rib provides a first sidewall to a first one of the discharge cells, and the second barrier rib provides a second sidewall to the first discharge cell. The first barrier rib extends generally in a first direction substantially parallel to the substantially planar surface and has a first height, which is the length of the first barrier rib in a third direction perpendicular to the substantially planar surface. The second barrier rib extends generally in a second direction substantially parallel to the substantially planar surface and has a second height, which is the length of the second barrier rib in the third direction. The first height is greater than the second height.

In the above-described device, the first barrier rib has a first thickness, which is the length of the first barrier rib in a direction perpendicular to the first direction on a plane parallel to the substantially planar surface. The second barrier rib has a second thickness, which is the length of the second barrier rib in a direction perpendicular to the second direction on the plane. The second thickness may be greater than the first thickness. The second thickness may be greater than the second thickness by at least about 15 μm. The first and second sidewalls are neighboring sidewalls of the first discharge cell and form an angle therebetween, and wherein the angle may be from about 60° to less than about 150°. The angle may be from about 110° to about 130°. The angle may be about 80° to about 100°.

Still in the above-described device, the first discharge cell has a top wall generally facing the second substrate and a bottom wall generally facing the top wall, wherein the first barrier rib has two ends in the third direction and contacts both the top and bottom walls at or about the two ends. The second barrier rib has two ends in the third direction and contacts one of the top and bottom walls, and wherein a clearance may be formed between the second barrier rib and one of the top and bottom walls. One or more additional barrier ribs provide the first discharge cell with one or more additional sidewalls, wherein each additional barrier rib has a height, which is the length thereof in the third direction, and wherein the height of each additional barrier rib may be greater than the second height. Each additional sidewall has two ends in the third direction and contacts both the top and bottom walls at or about the two ends. The second barrier rib has a top end and a bottom end in the third direction, wherein the second barrier rib contacts the bottom wall at or about the bottom end thereof, and wherein a clearance may be formed between the top end of the second barrier and the top wall. A ratio of the length of the first barrier rib in the first direction to the length of the second barrier rib in the second direction is from about 0.5 to about 2.

Another aspect of the invention provides a plasma display device. The device comprises: a first substrate having a substantially planar surface; a second substrate opposing the first substrate; a plurality of discharge cells arranged between the first and second substrates; and a plurality of barrier ribs between the first substrate and the second substrate. Each discharge cell is defined by a plurality of sidewalls, a top wall generally facing the second substrate and a bottom wall generally opposing the bottom wall, wherein the plurality of barrier ribs provide the plurality of sidewalls. Each discharge cell has at least two holes in at least two sidewalls, each holes comprises a clearance formed between the top wall and one of the sidewalls, each hole connects to a neighboring discharge cell to allow fluid communication with the neighboring discharge cell.

In the foregoing device, the at least two holes of each discharge cell may be arranged so as to form a generally linear passage of fluid flow. The at least two holes of each discharge cell may be arranged so as to form two generally linear passages of fluid flow. Two of the at least two holes may be formed in two sidewalls, each of which is substantially opposing the other. The first discharge cell comprises a first sidewall provided by a first barrier rib having a first height, which is the length of the first barrier rib in a direction perpendicular to the substantially planar surface, wherein the first discharge cell comprises a second sidewall provided by a second barrier rib having a second height, which is the length of the second barrier rib in the direction, and wherein the first height may be greater than the second height. The first barrier rib has a first thickness, which is the length of the first barrier rib on a plane parallel to the substantially planar surface, wherein the second barrier rib has a second thickness, which is the length of the second barrier rib on the plane, and wherein the second thickness may be greater than the first thickness. The second thickness may be greater than the second thickness by at least about 15 μm. Two neighboring sidewalls of each discharge cell form an angle therebetween, and wherein the angle may be from about 60° to less than about 150°.

An advantage of the invention is that it provides a plasma display panel having improved exhaust efficiency with the closed structure of a barrier rib. According to one aspect of the invention, a plasma display panel includes first and second substrates that face each other; barrier ribs that are located in a space between the first substrate and the second substrate for dividing a plurality of discharge cells in sealed spaces; display electrodes located along the discharge cells; and address electrodes formed in a direction intersecting the display electrodes. The barrier ribs include first barrier ribs each having a large thickness, and second barrier ribs each having a relatively smaller thickness than the first barrier ribs.

In one embodiment, the first barrier ribs and the second barrier ribs are regularly disposed in a fixed direction. At this time, the first barrier ribs may be formed in a direction where the address electrodes extend, and in a direction intersecting the direction where the address electrodes extend, and may be formed in a diagonal direction. In one embodiment, a difference in thickness between the first and second barrier ribs is equal to or greater than at least 15 μm. In one embodiment, the barrier ribs divide the discharge cells such that sub-pixels constituting one pixel are disposed to form a triangular shape.

According to another aspect of the invention, a plasma display panel includes first and second substrates that face each other; barrier ribs that are located in a space between the first substrate and the second substrate for dividing a plurality of discharge cells in sealed spaces; display electrodes located along the discharge cells; and address electrodes formed in a direction intersecting the display electrodes. The barrier ribs include first barrier ribs each having a large thickness, and second barrier ribs each having a relatively smaller thickness than the first barrier ribs, and a ratio of a length of the first barrier rib (L2) to a length of the second barrier rib (L1) (L2/L1) is within a range of from 0.5 to 2.0. In one embodiment, the second barrier ribs are connected to the first barrier ribs.

BRIEF DESCRIPTION OF THE DRAWINGS

These and/or other aspects and advantages of the invention will become apparent and more readily appreciated from the following description of the embodiments, taken in conjunction with the accompanying drawings.

DETAILED DESCRIPTION OF EMBODIMENTS

Figure 1:
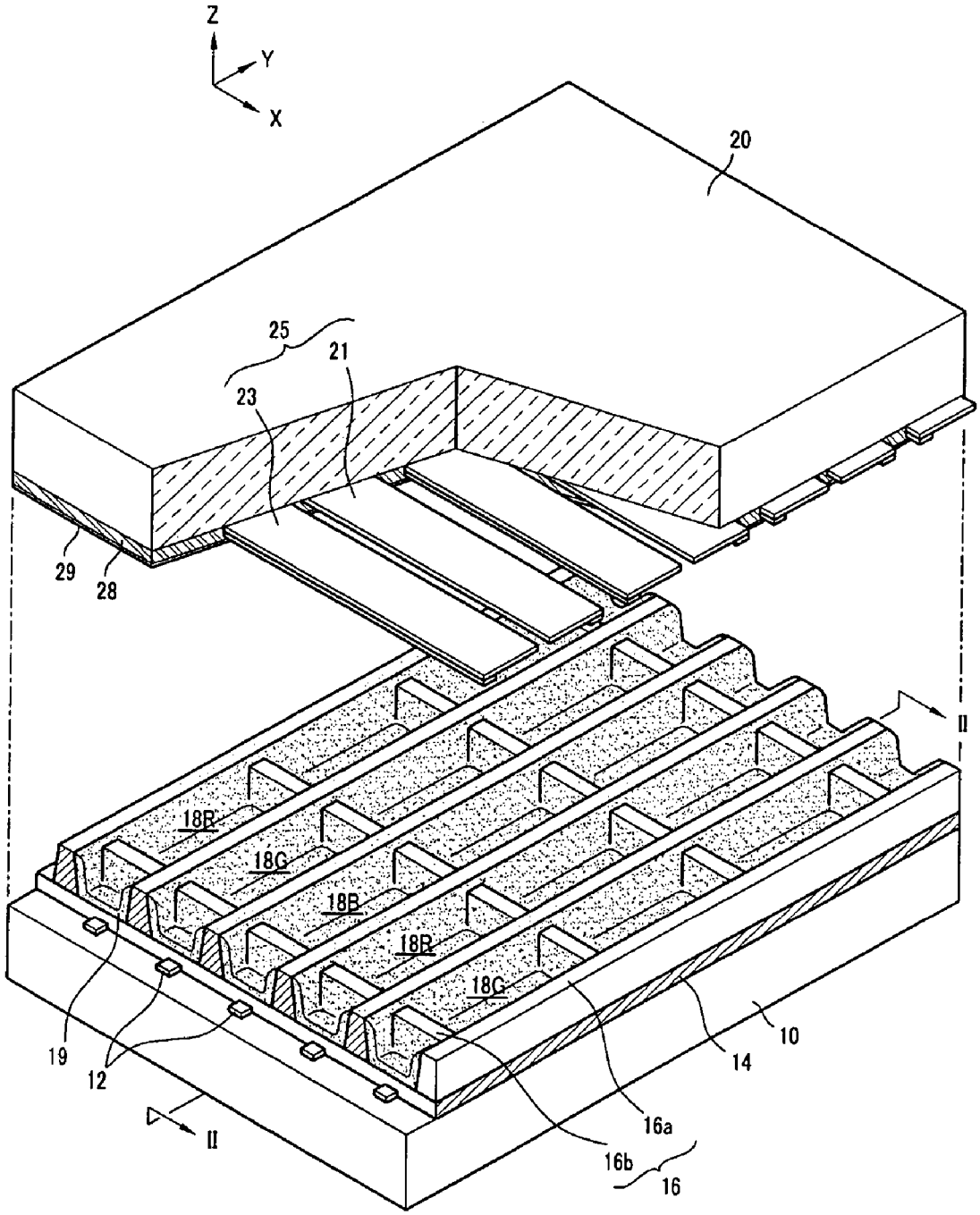
FIG. 1 is a partial exploded perspective view of a plasma display panel according to an embodiment of the invention.
Figure 2:
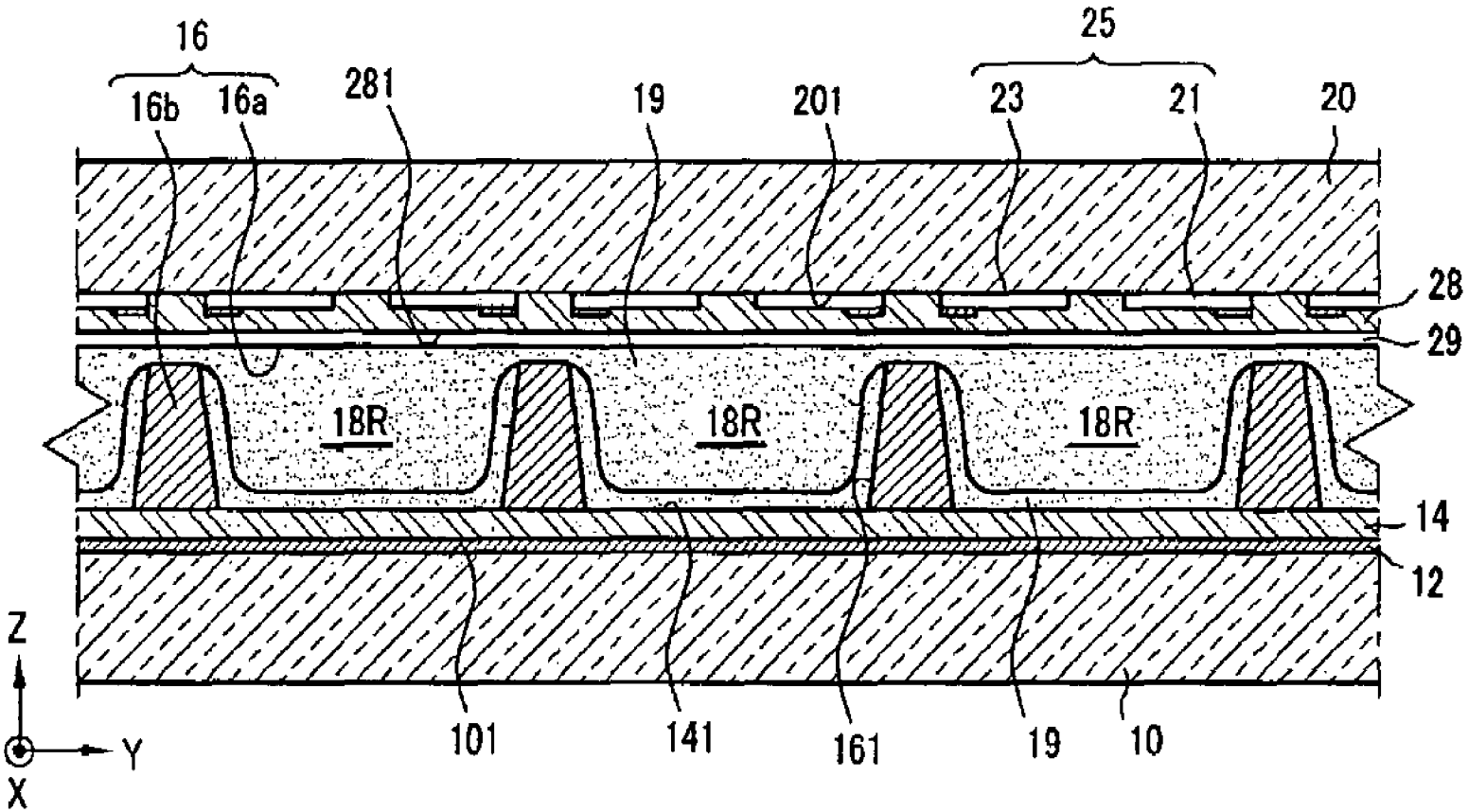
FIG. 2 is a partial cross-sectional view of the plasma display panel taken along the line II-II of FIG. 1.

FIG. 1 is a partial exploded perspective view showing a plasma display panel according to an embodiment of the invention, and FIG. 2 is a partial cross-sectional view taken along the line II-II of FIG. 1.

Referring to FIGS. 1 and 2, a rear substrate 10 and a front substrate 20 are arranged to face each other with a predetermined gap therebetween. In the space between the substrates 10 and 20, a number of discharge cells 18R, 18G, and 18B are formed by the configuration of the barrier ribs 16.

In each discharge cell 18, a phosphor layer 19, is formed on a wall surface 161 of the barrier rib and a bottom surface 141. Each discharge cell 18 is filled with a discharge gas (for example, containing Xe and Ne) which, upon application of a certain voltage within the cell, generates a plasma state and ultraviolet light which excites the phosphor. The phosphor molecules emit visible light when returning to their normal state after excitation.

In the illustrated embodiment, the front substrate 20 is formed of a transparent material like glass through which visible light can be transmitted such that images are displayed. The display electrodes 25 are formed in one direction (an X-axis direction of the drawing) on the bottom surface 201 of the front substrate 20 over the discharge cells 18. The display electrode 25 is composed of a scan electrode 21 and a sustain electrode 23. The scan electrode 21 acts with an address electrode 12 to select a discharge cell to be turned on. The sustain electrode 23 acts with the scan electrode 21 to allow sustain discharge to be generated in the selected discharge cell.

The display electrodes 25 are covered with a dielectric layer 28 formed of a dielectric, such as PbO, $B_2O_3$, and $SiO_2$. The dielectric layer 28 prevents damage of the display electrodes 25 due to collision of charged particles directly with the display electrodes 25 at the time of discharging.

Further, as in the illustrated embodiment, a bottom surface 281 of the dielectric layer 28 may be covered with a protective film 29 formed of MgO or the like. The protective film 29 prevents damage of the dielectric layer 28 that would have been caused by collision of charged particles thereto but for the protective film 29. Further, when the charged particles collide with the protective film 29, the protective film 29 may emit secondary electrons, and thus serves to improve discharge efficiency. In the illustrated embodiment, the protective film provides a ceiling or top surface of the discharge cells 18R.

In addition, on a top surface 101 of the rear substrate 10 facing the front substrate 20, the address electrodes 12 extend in a direction intersecting the display electrodes 25 (a Y-axis direction of the drawing). The address electrodes 12 and the display electrodes 25 are spaced apart in such a manner that discharge cells are located between these electrodes 12 and 25. These address electrodes 12 are covered with the dielectric layer 14, and barrier ribs 16 are formed in a predetermined pattern on the dielectric layer 14.

The barrier ribs 16 partition the discharge cells 18 serving as discharge spaces where the discharge is made. The barrier ribs 16 also prevent crosstalk from occurring between adjacent discharge cells 18. As shown in the drawings, the barrier ribs 16 include barrier ribs 16*a* extending generally in the Y direction and barrier ribs 16*b* extending generally in the X direction. The barrier ribs 16*a* are spaced apart from each other along the Y direction, and the barrier ribs 16*b* are also spaced apart from each other along the X direction. The barrier ribs 16*a* and 16*b* together define the discharge cells 18 substantially isolated from each other (a closed structure). In embodiments of the invention, at least one of the barrier ribs 16*a* and 16*b* defining a discharge cell has a different height from the other. In the illustrated embodiment, the height of the barrier ribs 16*a* is larger than that of the barrier rib 16*b*.

The difference in height between the barrier ribs serves to form passages between adjacent discharge cells to improve exhaust efficiency. In other words, neighboring discharge cells form passages which allow fluid communication among them therethrough as one or more barrier ribs of the discharge cells are shorter than the other barrier ribs in the Z direction (FIG. 1). In some embodiments, the difference in the heights of the barrier ribs is about 15 μm or greater.

Figure 3:
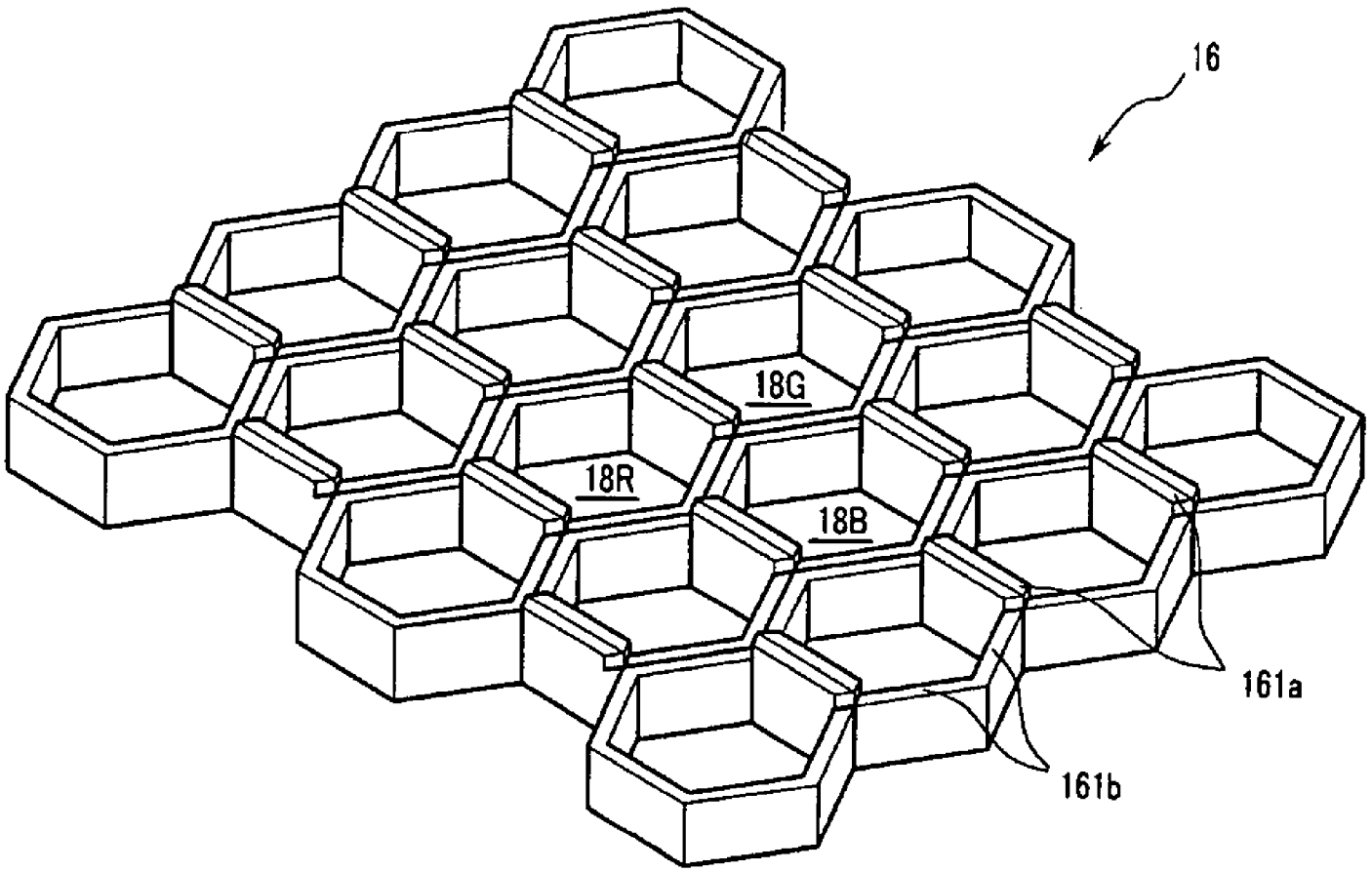
FIG. 3 is a perspective view showing an arrangement of barrier ribs according to an embodiment of the invention.

The barrier rib will be described in detail below. The structure of the barrier rib described herein is only an example for exemplifying the closed structure of the barrier rib. FIG. 3 is a perspective view showing a barrier rib according to a second embodiment of the invention. In the embodiment illustrated in FIG. 3, each discharge cell has a hexagonal shape partitioned by barrier ribs. In this embodiment, a set of three neighboring discharge cells 18R, 18G and 18B disposed in a triangular shape constitute a pixel. The barrier ribs 16 include first barrier ribs 161*a* (hereinafter, referred to as 'a linear barrier rib') extending in one direction and second and third barrier ribs 161*b*, which are together referred to as 'a bent barrier rib'.

The linear barrier rib 161*a* extends generally in a direction, in which the address electrode extends. The bent barrier rib 161*b* connects to a pair of neighboring linear barrier ribs 161*a* in a direction intersecting the linear barrier rib 161*a* and defines the discharge cell 18 to have a polygonal shape, including a hexagonal shape as in FIG. 3.

In embodiments, the barrier ribs defining a discharge cell may have different heights. FIG. 3 shows an embodiment in which the height of the linear barrier rib 161*a* is larger than that of the bent barrier rib 161*b*. The difference in height of the barrier ribs creates passages between adjacent discharge cells which improve exhaust efficiency, and which will be described in detail below.

Referring to FIG. 1 again, a phosphor layer 19 is formed in each discharge cell 18. As shown in FIG. 1, the phosphor layer 19 is formed over the bottom surface 141 of the dielectric layer 14 and the sidewall surfaces 161 of the barrier ribs 16. In order to emit colored visible light, each of the phosphor layers 19 is formed using one of a red phosphor, a green phosphor, and a blue phosphor. As described above, a discharge gas containing Ne and Xe is filled in the discharge cell 18, in which the phosphor layer 19 is disposed.

Hereinafter, some additional configurations of the barrier ribs according to various embodiments will be described in detail with reference to FIGS. 4 to 7. In FIGS. 4A, 4B, 5A, and 5B, the barrier rib 16 is solidified from a paste state. Since the material of the barrier rib 16 contracts in a solidifying process, the barrier ribs are formed using the contraction property such that they have different heights.

Figure 4A:
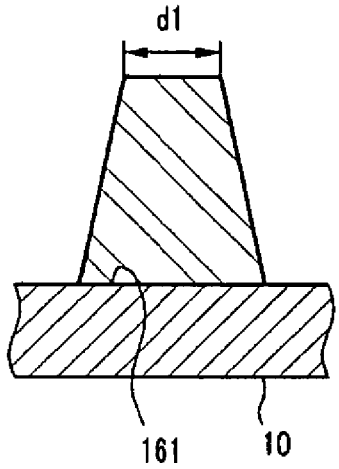
FIG. 4A illustrates a barrier rib prior to baking.
Figure 4B:
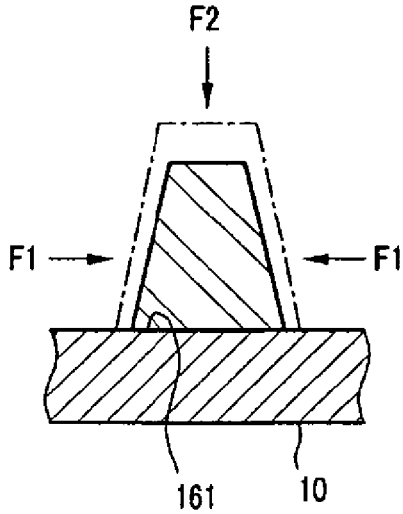
FIG. 4B illustrates the barrier ribs of FIG. 4A after baking.
Figure 5A:
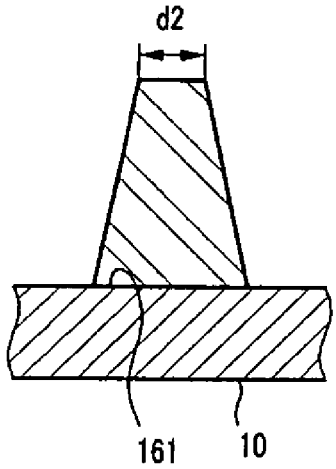
FIG. 5A illustrates another barrier rib prior to baking.
Figure 5B:
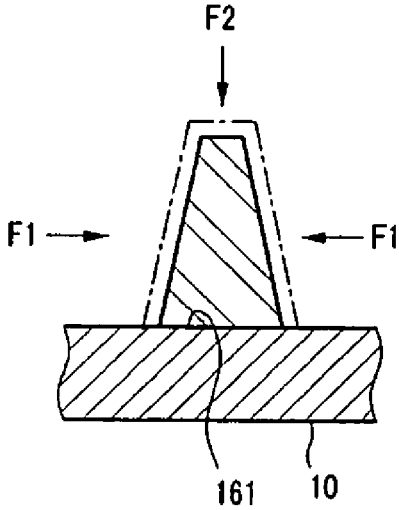
FIG. 5B illustrates the barrier rib of FIG. 5A after baking.

The contraction property of the material for the barrier rib varies depending on its thickness. FIGS. 4A and 4B are diagrams illustrating the contraction of a barrier rib as it is baked in the manufacturing process. FIGS. 5A and 5B are diagrams illustrating the contraction of another barrier rib, which has a thickness smaller than that illustrated in FIGS. 4A and 4B. In addition, FIGS. 4A and 5A show a state before the barrier rib is contracted, and FIGS. 4B and 5B show a state after the barrier rib is contracted. In FIGS. 4B and 5B, a shape in the one-dot chain line represents a shape of barrier rib prior to baking.

As described above, barrier rib paste is made of a mixture of filler, glass powder, a binder, and a solvent. Among these materials, the solvent is evaporated during the process of applying paste on the substrates and then drying it. The binder is evaporated during the process of baking the paste, and the final material forming the barrier rib is made of filler and glass. During the baking process, the glass powder is melted, so that fillers are bonded together, thereby forming solid barrier ribs.

As such, the barrier rib (its material) changes its state in the manufacturing process. Further, because the solvent and binder are expelled in the process, the barrier rib is contracted as a whole. The degree of the contraction may vary depending upon the composition and other conditions including baking temperature. Theoretically, the contraction ratio should be equal in all directions. However, since the paste contacts the rear substrate, the barrier rib contracts anisotropically.

As illustrated, in FIGS. 4A, 4B, 5A, and 5B, the bottom surface 161 of the barrier rib contacts the substrate 10. For this reason, the contraction or deformation of the barrier rib is restricted by the substrate 10. The amount of contraction along the surface of the substrate 10 is smaller than it would have been without the contact with the substrate 10. However, deformations of other portions in the other directions are not restricted, so that the other portions have a larger contraction than the bottom surface 161. Therefore, in the paste before the baking (in FIG. 4A), the deformation restricted by the substrate 10 influences the height. Because the contraction is limited along the surface of the substrate 10, portions away from the substrate 10 undergoes much more significant contraction. Also, the contact with the substrate 10 limits the contraction more in the lateral direction than in the vertical direction. Therefore, decrease in the height can be greater than ideal contraction.

However, the degree of the deformation may vary depending on the thickness of the barrier rib. For example, when a thickness d2 is small, a deformation force F1 applied in a direction parallel to the bottom surface 161 is stronger than a deformation force $F_2$ applied in a direction vertical to the bottom surface 161, so that the height of the barrier rib may increase after the baking.

On the other hand, when the thickness d1 of the barrier rib is large (FIGS. 4A and 4B), the barrier rib contracts more by the deformation force F2 rather than the deformation force F1 depending on the thickness d2 of the barrier rib, so that the contraction increases in a vertical direction. As a result, the height of the barrier rib after the baking decreases more than FIG. 5B.

In embodiments, barrier ribs 161*a* and 161*b* have different thicknesses. Therefore, since the barrier ribs 161*a* and 161*b* are baked from the mold of its paste with the same height, the difference in the heights can be generated among the barrier ribs. The difference in the heights of the barrier ribs creates gaps between the top of the barrier ribs with shorter heights and the ceiling of the discharge cells. These gaps serve as passages among the discharge cells to allow smooth exhaust of impurities introduced in the discharge cells during the manufacturing of the PDP device.

The barrier ribs of the embodiments may be produced using the sand blasting method as described above. FIGS. 6A, 6B, 6C, 6D, 6E, and 6F show patterns of the barrier ribs to form passages in the hexagonal discharge cells. In the drawings, a thick line indicates barrier ribs which are relatively thick. In addition, in FIGS. 6A, 6B, 6C, 6D, 6E, and 6F, an arrow indicates a passage forming direction.

Figure 6A:
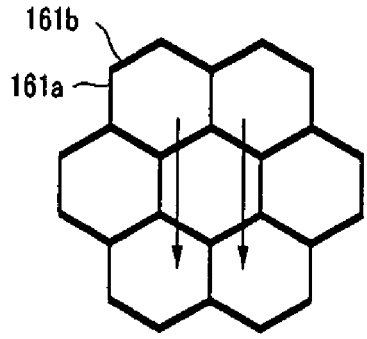
FIGS. 6A through 6F illustrate various embodiments of hexagonal discharge cell configurations, in which various forms of passages are provided.

FIG. 6A illustrates a barrier rib pattern in which the bent barrier ribs 161*b* have a larger thickness than the linear barrier ribs 161*a*. According to this pattern, when the barrier rib paste is baked, the bent barrier ribs 161*b* having a large thickness will become shorter than the linear barrier rib 161*a* having a relatively smaller thickness. Therefore, clearances are formed between the bent barrier ribs 161*b* and the ceiling of the discharge cells. With these clearances, a passage of flow of impurities or any gases can be established along the direction of the arrows of FIG. 6A or the opposite direction thereof.

Figure 6B:
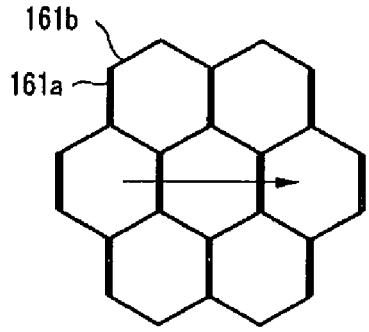

FIG. 6B illustrates an embodiment in which the linear barrier rib 161*a* is thick and the bent barrier rib 161*b* is thin. The barrier rib paste prior to the baking has the same height for the linear barrier rib 161*a* and the bent barrier rib 161*b*. In this embodiment, when the barrier rib paste is baked, the linear barrier rib 161*a* becomes shorter than the bent barrier rib 161*b*. With these clearances, a passage of flow of impurities and gases can be established along the direction of the arrow in FIG. 6B or in the opposite direction thereof. Therefore, clearances are formed between the ceiling of the discharge cells and the linear barrier ribs.

Figure 6C:
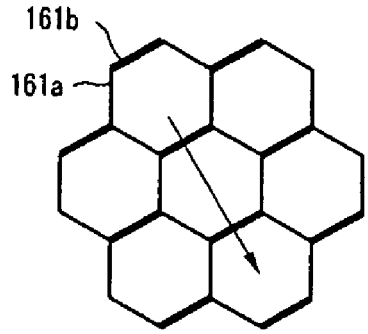
Figure 6D:
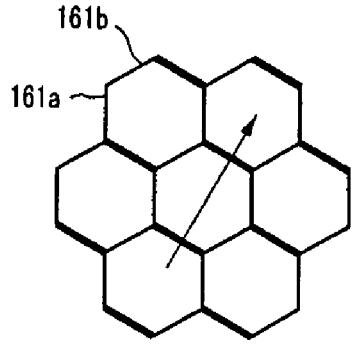
Figure 6E:
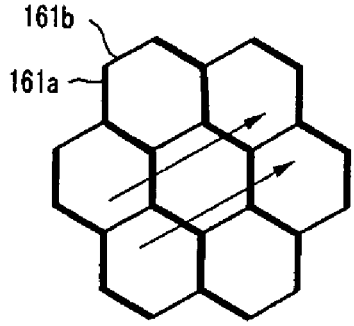
Figure 6F:
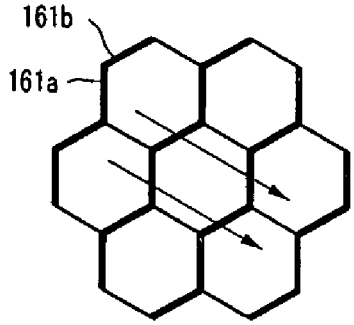

FIGS. 6C and 6D are embodiments with other arrangements of thicker barrier ribs. Particularly, only one barrier rib of a single discharge cell is selectively thick. FIGS. 6E and 6F are other embodiments in which only one of a single discharge cell is thinner than the other barrier ribs thereof.

In FIGS. 6A, 6B, 6C, 6D, 6E, and 6F, barrier ribs each having a large thickness are regularly arranged. As illustrated, barrier ribs having a larger thickness are arranged such that the thick barrier ribs extend generally in the horizontal (left-right) direction in FIG. 6A. Barrier ribs having a larger thickness are arranged such that the thicker barrier ribs extend generally in the vertical (up-down) direction in FIG. 6B. In FIGS. 6C, 6D, 6E, and 6F, barrier ribs having a larger thickness are disposed such that the thicker barrier ribs generally extend in a diagonal (slanted) direction. Since this arrangement having a predetermined pattern can form passages in one direction in the PDP having a plurality of discharge cells, it is possible to improve the exhaust efficiency.

In addition to the embodiment in which the difference in the height of the barrier ribs is generated due to the difference in thickness, the difference in the height of the barrier ribs may also be generated by a difference of the length of the barrier ribs. Equation 1 represents the relationships between the thicknesses and the lengths of the barrier ribs.

$$\frac{L2}{L1} = 0.5 - 2.0 \qquad \text{[Equation 1]}$$

Figure 7:
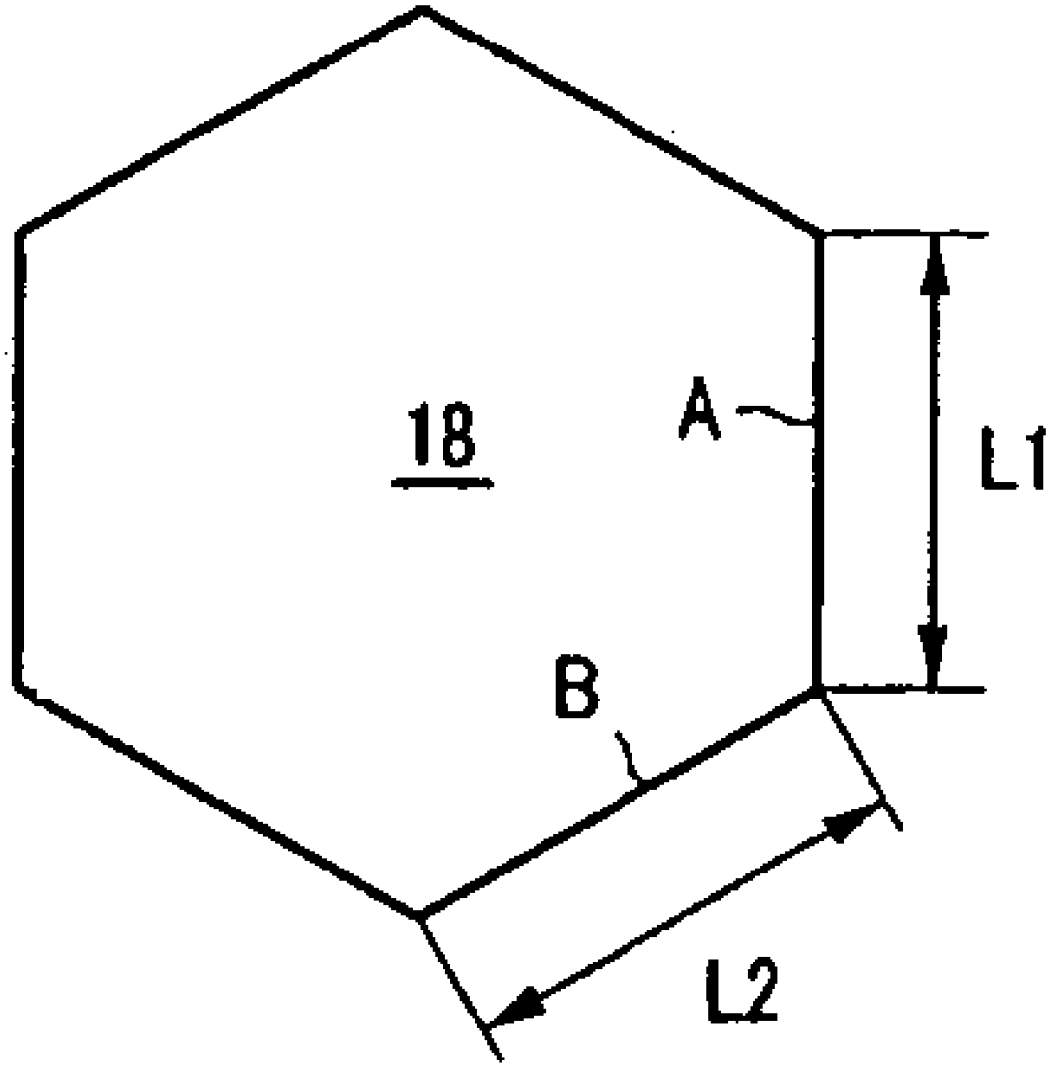
FIG. 7 illustrates heights and lengths of the barrier ribs in a hexagonal discharge cell.

Here, "L1" refers to the length of a barrier rib having a smaller thickness, and "L2" refers to the length of a barrier rib having a larger thickness. Equation 1 represents the relationships between the barrier ribs having the smaller thickness and the barrier ribs having the larger thickness when they are connected to each other. For example, as shown in FIG. 7, a barrier rib A having a smaller thickness is formed in a hexagonal discharge cell, and a barrier rib B having a larger thickness is connected to the barrier rib A. In an embodiment the length of the barrier rib A ('L1') and the length of the barrier rib B ('L2') have the relationship that a ratio of lengths 'L2'/'L1' is within a range of from 0.5 to 2.0. This relationship provides certain variation in the height of these barrier ribs to create a passage in the discharge cell.

In addition, in a case of patterning the dry film resist used as the mask in the process of manufacturing the barrier rib, the thickness is preferably determined so as to satisfy the above-mentioned conditions because the following problems may occur. When patterning the dry film, the thickness of the barrier rib is determined by exposing the dry film. In this case, when the length of the barrier rib is short in order to obtain the small thickness, there is a problem in that in the process of exposing the pattern of the barrier rib having the large thickness formed subsequent to the barrier rib having a small thickness, the pattern having the small thickness is more exposed, and the thickness thereof becomes larger than a desired thickness.

According to the present invention, since the passages are formed through the exhaust grooves in the PDP having the closed structure of the barrier rib in order to solve the above-mentioned problems, there is an advantage in that the exhaust can be easily achieved. In addition, since the exhaust grooves are provided only with respect to the discharge cells of the same color so as not to generate crosstalk, stable discharging can be made while sustaining the discharge cell with an independent space.

Although the exemplary embodiments of the present invention have been described in detail hereinabove in connection with the accompanying drawings, it should be understood that the invention is not limited to the disclosed exemplary embodiments. It will be apparent to those skilled in the art that various modifications and changes can be made in the present invention without departing from the spirit or scope of the invention and the claims described below.

What is claimed is:

1. A plasma display device, comprising:

a first substrate having a substantially planar surface;

a second substrate opposing the first substrate;

a plurality of barrier ribs that are located between the first substrate and the second substrate to partition a plurality of discharge cells, the plurality of barrier ribs comprising a first barrier rib and a second barrier rib;

wherein the first barrier rib provides a first sidewall to a first one of the discharge cells, and the second barrier rib provides a second sidewall to the first discharge cell;

wherein one or more additional barrier ribs provide the first discharge cell with one or more additional sidewalls, wherein each additional barrier rib has a height, which is the length thereof in a third direction, and wherein the height of each additional barrier rib is greater than the second height;

wherein the first barrier rib extends generally in a first direction substantially parallel to the substantially planar surface and has a first height, which is the length of the first barrier rib in the third direction perpendicular to the substantially planar surface;

wherein the second barrier rib extends generally in a second direction substantially parallel to the substantially planar surface and has a second height, which is the length of the second barrier rib in the third direction; and wherein the first height is greater than the second height.

2. The device of claim 1, wherein the first barrier rib has a first thickness, which is the length of the first barrier rib in a direction perpendicular to the first direction on a plane parallel to the substantially planar surface, wherein the second barrier rib has a second thickness, which is the length of the second barrier rib in a direction perpendicular to the second direction on the plane, and wherein the second thickness is greater than the first thickness.

3. The device of claim 2, wherein the second thickness is greater than the first thickness by at least about 15 μm.

4. The device of claim 1, wherein the first and second sidewalls are neighboring sidewalls of the first discharge cell and form an angle therebetween, and wherein the angle is from about 60° to less than about 150°.

5. The device of claim 4, wherein the angle is from about 110° to about 130°.

6. The device of claim 4, wherein the neighboring sidewalls form an angle therebetween, and wherein the angle is about 80° to about 100°.

7. The device of claim 1, wherein the first discharge cell has a top wall generally facing the second substrate and a bottom wall generally facing the top wall, wherein the first barrier rib has two ends in the third direction and contacts both the top and bottom walls at or about the two ends.

8. The device of claim 7, wherein the second barrier rib has two ends in the third direction and contacts one of the top and bottom walls, and wherein a clearance is formed between the second barrier rib and one of the top and bottom walls.

9. The device of claim 1, wherein each additional sidewall has two ends in the third direction and contacts both the top and bottom walls at or about the two ends.

10. The device of claim 9, wherein the second barrier rib has a top end and a bottom end in the third direction, wherein the second barrier rib contacts the bottom wall at or about the bottom end thereof, and wherein a clearance is formed between the top end of the second barrier and the top wall.

11. The device of claim 1, wherein a ratio of the length of the first barrier rib in the first direction to the length of the second barrier rib in the second direction is from about 0.5 to about 2.

12. A plasma display device, comprising:

a first substrate having a substantially planar surface;

a second substrate opposing the first substrate;

a plurality of discharge cells arranged between the first and second substrates;

a plurality of barrier ribs being located between the first substrate and the second substrate;

wherein each discharge cell is defined by a plurality of sidewalls, a top wall generally facing the second substrate and a bottom wall generally facing the second substrate and opposing the top wall, wherein the plurality of barrier ribs provide at least three sidewalls that are interposed between the top and bottom walls;

wherein each discharge cell has at least two holes in at least two sidewalls, and each hole comprises a clearance formed between the top wall and one of the sidewalls, and each hole connects to a neighboring discharge cell to allow fluid communication with the neighboring discharge cell;

wherein a first discharge cell comprises a first sidewall provided by a first barrier rib and a second sidewall provided by a second barrier rib, wherein the first barrier rib has a first thickness and a first height, which is the length of the first barrier rib on a plane parallel to the substantially planar surface, the second barrier rib has a second thickness and a second height which is less than the first height, which is the length of the second barrier rib on the plane, and wherein the second thickness is greater than the first thickness; and wherein one or more additional barrier ribs provide the first discharge cell with one or more additional sidewalls, wherein each additional barrier rib has a height, which is the length thereof in a third direction, and wherein the height of each additional barrier rib is greater than the second height.

13. The device of claim 12, wherein the at least two holes of each discharge cell are arranged so as to form a generally linear passage of fluid flow.

14. The device of claim 12, wherein the at least two holes of each discharge cell are arranged so as to form two generally linear passages of fluid flow.

15. The device of claim 12, wherein two of the at least two holes are formed in two sidewalls, each of which is substantially opposing the other.

16. The device of claim 12, wherein the second thickness is greater than the first thickness by at least about 15 μm.

17. The device of claim 12, wherein two neighboring sidewalls of each discharge cell form an angle therebetween, and wherein the angle is from about 60° to less than about 150°.

* * * * *